US005367249A

United States Patent [19]

Honnigford

[11] Patent Number: 5,367,249

[45] Date of Patent: Nov. 22, 1994

[54] CIRCUIT INCLUDING BANDGAP REFERENCE

[75] Inventor: Edward H. Honnigford, Russiaville, Ind.

[73] Assignee: Delco Electronics Corporation, Kokomo, Ind.

[21] Appl. No.: 48,847

[22] Filed: Apr. 21, 1993

[51] Int. Cl.[5] ..... G05F 3/16; G05F 3/20

[52] U.S. Cl. ..... 323/313; 323/901

[58] Field of Search ..... 323/313, 901, 314, 315

[56] References Cited

U.S. PATENT DOCUMENTS

| | | | |
|---|---|---|---|
| 3,648,154 | 3/1972 | Frederiksen et al. | 323/227 |
| 4,419,594 | 12/1983 | Gemmell et al. | 323/315 X |
| 4,618,816 | 10/1986 | Monticelli | 323/316 X |
| 4,839,535 | 6/1989 | Miller | 307/296.7 |
| 4,857,823 | 8/1989 | Bitting | 323/314 |
| 4,890,214 | 12/1989 | Yamamoto | 363/49 |
| 5,061,862 | 10/1991 | Tamagawa | 307/296.1 |
| 5,081,410 | 1/1992 | Wood | 323/316 |
| 5,084,665 | 1/1992 | Dixon et al. | 323/281 |
| 5,087,830 | 2/1992 | Cave et al. | 307/296.6 |

OTHER PUBLICATIONS

U.S. Statutory Invention Registration No. H743 published on Feb. 6, 1990 (Bismark).

*Temperature Compensated Current Reference*, Research Disclosure, p. 419, May 1992.

*Primary Examiner*—Kristine L. Peckman

*Assistant Examiner*—E. To

*Attorney, Agent, or Firm*—Anthony L. Simon; Jimmy L. Funke

[57] ABSTRACT

An apparatus comprises a bandgap reference voltage circuit with first and second current legs and circuitry for generating a bandgap reference voltage. A transistor is coupled to the first current leg for selectively providing current to the first leg of the bandgap reference voltage circuit. A control circuit controls the transistor to turn the transistor on when an external voltage supply is initially applied to the apparatus to provide a start up current to the bandgap voltage reference source and senses an output voltage developed by the bandgap reference current source. The control circuit turns off the transistor responsive to the sensed developed voltage when the sensed developed voltage rises above a predetermined threshold.

4 Claims, 3 Drawing Sheets

CIRCUIT INCLUDING BANDGAP REFERENCE

The subject of this application is related to the subject of copending U.S. patent application, Ser. No. 08/049,779, filed concurrently with this application, assigned to the assignee of this invention, and incorporated herein by reference.

This invention relates to circuitry for use in an integrated circuit bandgap reference voltage supply.

BACKGROUND OF THE INVENTION

Integrated circuit regulated voltage supplies typically use a bandgap voltage reference as a fixed voltage reference in the voltage supply circuit. When circuits, such as those including bandgap voltage regulators, are used in automotive vehicles, the circuits are subject to extreme voltage conditions, including excess battery supply voltage and reverse voltage conditions. Typically, a voltage clamp and series resistance are used to provide protection from excess supply voltages. Typically, a series diode is used to protect against reverse voltages, which adds an additional voltage drop in the forward direction. Both of these known techniques require additional components and/or place limits on system performance.

Typical bandgap circuits are characteristically self stabilizing when on, but require a start up to transition from off to on.

SUMMARY OF THE PRESENT INVENTION

Advantageously, this invention provides a start up circuit for a bandgap voltage regulator. Advantageously, the circuit of this invention initializes a bandgap voltage reference in the proper state when a supply voltage is first applied. Advantageously, the apparatus of this invention initializes a bandgap reference by supplying a bias current to one leg of the reference circuit and, when the bandgap reference is established, releasing the bias current being supplied to the bandgap reference.

Structurally, the apparatus of this invention comprises a bandgap reference voltage circuit comprising first and second current legs and means for generating a bandgap reference voltage. A transistor is coupled to the first current leg and comprises means for selectively providing current to the first leg of the bandgap reference voltage circuit. A control circuit comprises (i) means for controlling the transistor to turn the transistor on when an external voltage supply is initially applied to the apparatus to provide a start up current to the bandgap voltage reference source and (ii) means for sensing an output voltage developed by the bandgap reference current source and for turning off the transistor responsive to the sensed developed voltage when the sensed developed voltage rises above a predetermined threshold.

A more detailed description of this invention is set forth below.

DETAILED DESCRIPTION OF THE INVENTION

Figure 1:
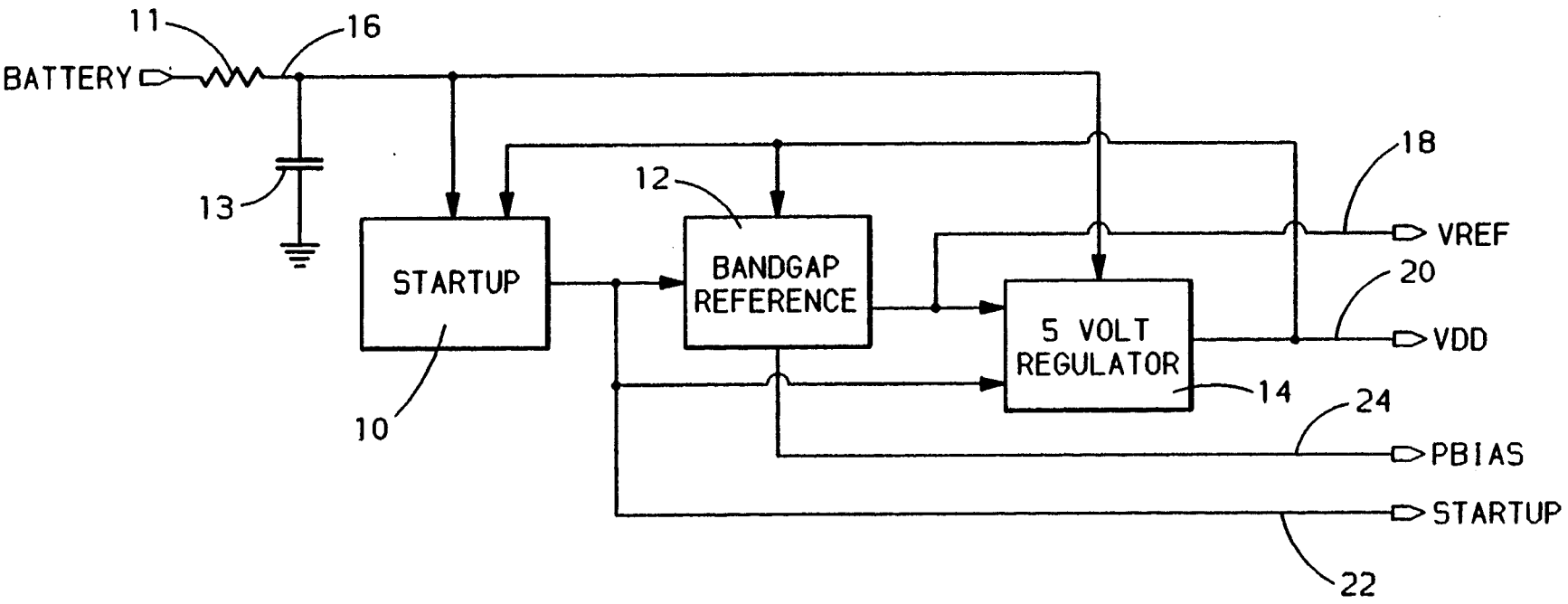
FIG. 1 illustrates a block diagram for a bandgap reference voltage supply using the circuitry of this invention.

Referring to FIG. 1, the circuit shown includes external resistor 11 and capacitor 13 for filtering high voltage, high frequency transients from the integrated circuit voltage supply comprising start up circuit 10, bandgap reference circuit 12 and 5 volt regulator circuit 14.

In general, a supply voltage such as provided by a vehicle power supply line is coupled via resistor 11 to line 16, which provides the supply voltage to start up circuit 10 and 5 volt regulator circuit 14. Start up circuit 10 is operational during initial connection of the circuit to a power supply. The start up circuit 10 provides a start up signal on line 22 to the bandgap reference circuit 12. A start up transistor in the bandgap reference circuit 12 (described in more detail below) is switched on by the start up signal, providing current flow through one leg of the bandgap reference circuit. In response, the bandgap reference output on line 18 rises. The 5 volt regulator circuit 14 amplifies the bandgap reference output and provides a signal $V_{DD}$ on line 20, that begins to ramp up to the desired 5 volt output level. When line 20 rises to a level at which the bandgap reference circuit can operate without the start up signal, start up circuit 10 shuts off the start up signal by bringing line 22 low. Bandgap reference circuit 12 is then operated from the regulated voltage supply line 20.

Figure 2:
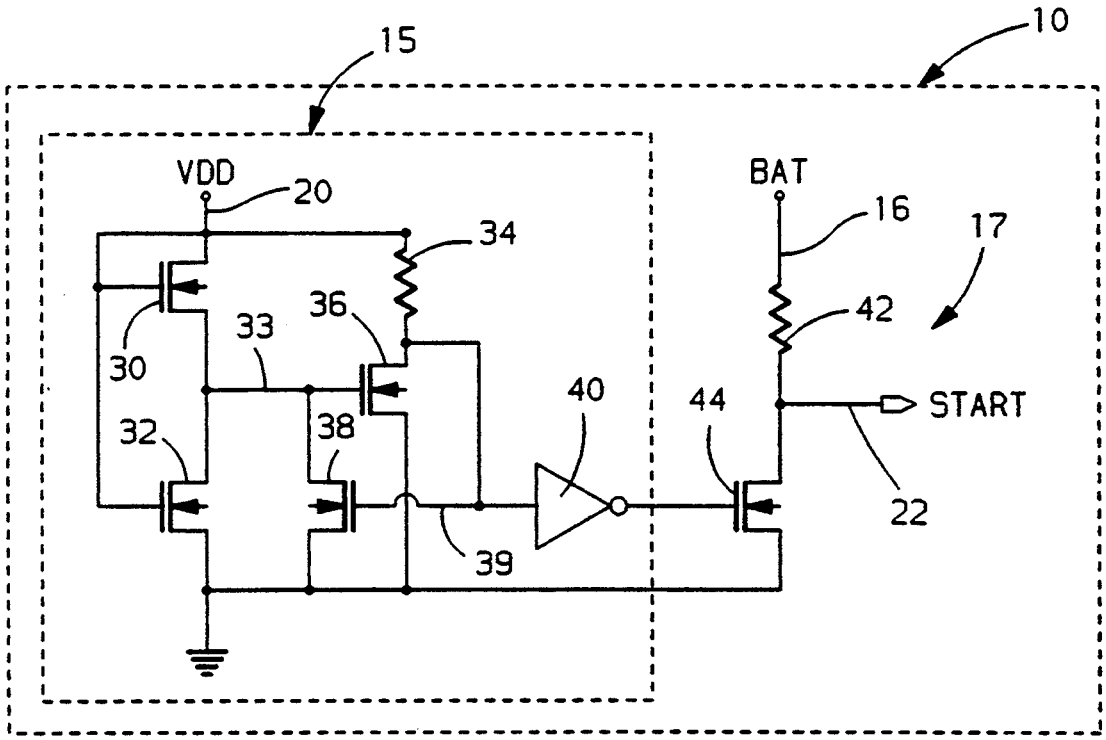
FIG. 2 illustrates a detailed circuit diagram of the start up circuit of this invention.

Referring to FIG. 2, the start up circuit 10 shown includes a series circuit 17 comprising resistor 42 and transistor 44 coupled between battery supply voltage on line 16 and ground. The node joining resistor 42 to transistor 44 is the output for the start signal on line 22. The remainder of the circuit comprises the control circuit 15, which is coupled to the gate of transistor 44.

In general, during start up when the supply voltage is initially provided to line 16, the gate of transistor 44 is held off and resistor 42 pulls line 22 high, providing the start signal to the band gap reference voltage generator. When the voltage supply line 20 ($V_{DD}$) goes high, control circuit 15 brings high the gate of transistor 44, coupling line 22 to ground, bringing low and turning off the start signal.

More particularly, in control circuit 15, transistors 30 and 32 form a voltage divider between the regulated voltage supply $V_{DD}$ on line 20 and ground. Transistor 32 acts as a light load to transistor 30, which operates as a source follower. When voltage is first applied to line 16 and when $V_{DD}$ on line 20 has not reached at least 3 volts, line 33 (the junction between transistors 30 and 32) is not high enough to turn on transistor 36. As a result, line 39 is pulled to the level of $V_{DD}$ on line 20 via resistor 34. When $V_{DD}$ on line 20 is at least one threshold above ground, inverter 40 provides low output to the gate of transistor 44, maintaining transistor 44 off and allowing resistor 42 to pull line 22 high.

In general, the start signal provides a start up current to the bandgap reference circuit 12, which provides a reference output to the 5 volt regulator circuit 14. 5 volt regulator circuit 14 amplifies the reference output and provides the 5 volt output, $V_{DD}$, on line 20. Transistor 36 is a high voltage transistor to provide a higher turn on threshold than transistors 30 and 32, increasing the threshold that $V_{DD}$ must achieve before the start signal goes low. Transistor 44 is a high voltage transistor because: (i) it is necessary to handle the high voltage supplied on line 16, and (ii) since transistor 36 is a high voltage transistor, implementing transistor 44 as a high voltage transistor ensures that inverter 40 becomes active and pulls the gate of transistor 44 low before transistor 44 can turn on and ground the start signal when the supply voltage (line 16) is first applied. Transistor 38 provides hysteresis to line 33.

As $V_{DD}$ (line 20) rises high enough, transistor 36 turns on grounding line 39, the input to inverter 40. Responsively, the gate of transistor 44 is driven high by inverter 40, grounding the start signal on line 22 and leaving bandgap reference circuit 12 to be driven off of the $V_{DD}$ voltage on line 20.

Resistors 34 and 42 are highly resistive p well diffused resistors, which reduce the current drain off of the supply voltage $V_{DD}$ (line 20) and the power supply (line 16), respectively, while using a minimum amount of area. Transistors 30 and 32 are both n channel transistors provided to ensure accurate voltage division of $V_{DD}$, regardless of process variations.

Figure 3:
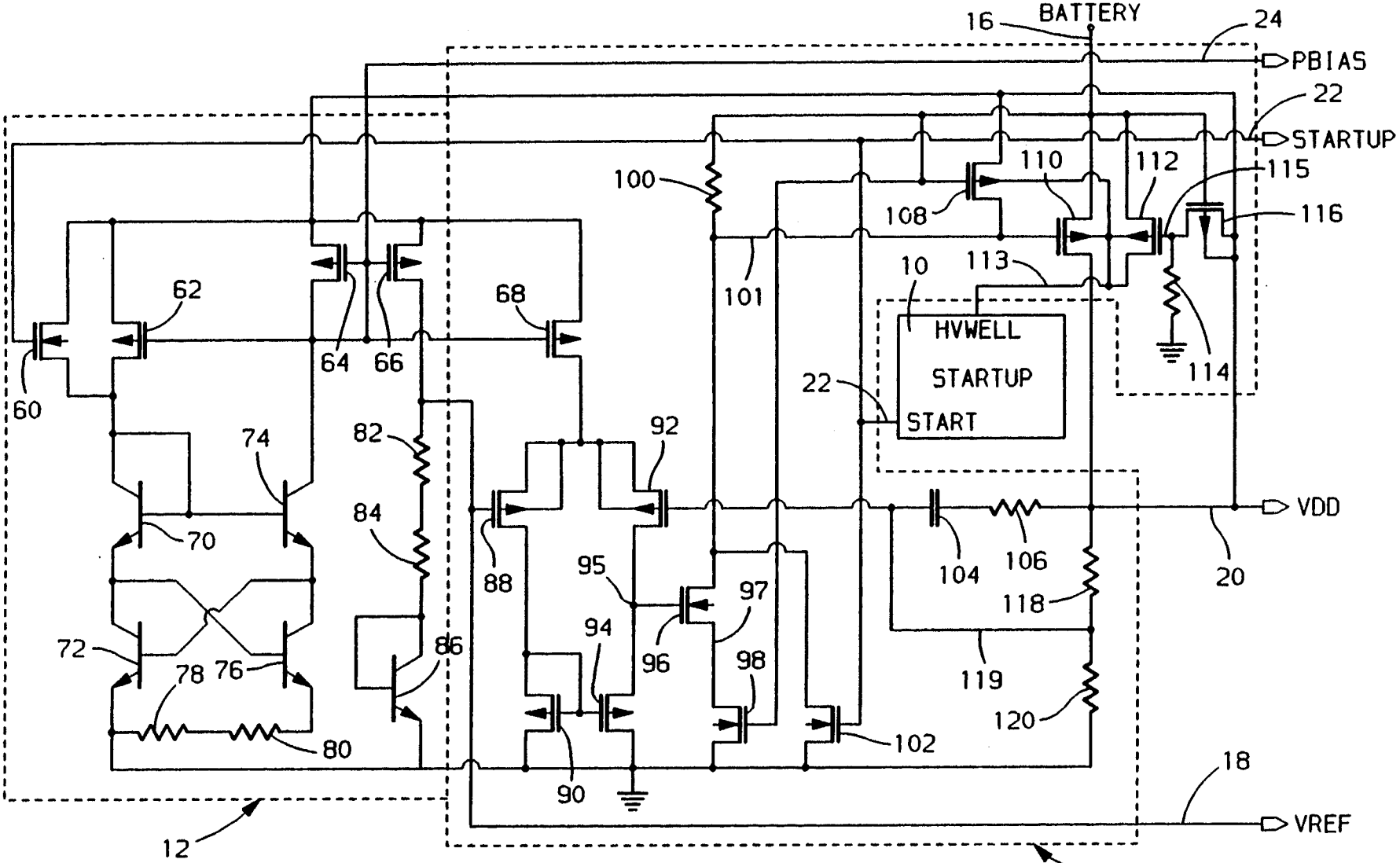
FIG. 3 illustrates a detailed circuit diagram of the bandgap reference voltage supply with reverse voltage protection according to this invention.

Referring now to FIG. 3, the detailed diagram illustrates the bandgap reference circuit 12, and 5 volt regulator circuit 14 with voltage drop and reverse current protection. Start up circuit 10 is shown as a block.

The bandgap reference circuit 12 comprises a conventional bandgap voltage regulator including transistors 62, 64, 66 and 70–76 and 86, as shown, and resistors 78, 80, 82 and 84. The bandgap reference generator provides stabilized voltage reference on line 18 of approximately 1.27 volts for use by the 5 volt regulator circuit and for any other necessary uses.

Transistor 64 acts as a source for current to transistors 74 and 76. The same current is mirrored through transistors 62 and 66. Transistor 66 develops a voltage across resistors 82 and 84 and transistor 86, which generate the 1.27 reference voltage on line 18. The ratio of the sum of resistors 82 and 84 to the sum of resistors 78 and 80 is set to cause maximum reference voltage on line 18 to occur at room temperature or slightly higher. In general, the temperature coefficient of the resistors 78, 80, 82 and 84 cancel out in the equation for the reference voltage on line 18.

More particularly, to eliminate the current variation with temperature as described in Research Disclosure, No. 337113, May, 1992, having a disclosure incorporated herein by reference, the resistor temperature coefficient for the sum of the resistances 82 and 84 must be equal to the temperature coefficient of the thermal voltage of the bipolar transistors. If a resistor with a temperature coefficient that matches the bipolar transistors is not available, two resistors may be provided, as shown, with coefficients above and below the desired value.

Resistors 82 and 84 have negative and positive diffusions respectively to obtain coefficients above and below the required coefficient of the bipolar transistors. By using the correct percentage of each type of resistance, the required temperature coefficient can be produced according to the following equation:

$$TC_{REQ}=X\,TC_{R1}+(1-X)TC_{R2},$$

where $TC_{REQ}$ is the required temperature coefficient, $TC_{R1}$ is the temperature coefficient of the n diffused resistor, $TC_{R2}$ is the temperature coefficient of the p diffused resistor and X is the percentage of the total resistance R82+R84 (the sum of the resistances of resistors 82 and 84) that belongs to resistor 82. Resistors 78 and 80, p diffused and n diffused, respectively, must have the same ratio mix as resistors 82 and 84 to prevent temperature variation of the reference voltage on line 18. Also, when determining the resistor values, the ratio of the sum of resistors 78 and 80 to the sum of resistors 82 and 84 must be maintained.

The bandgap reference generator is powered by the $V_{DD}$ reference on line 20 instead of battery reference on line 16 to provide good power supply rejection. This allows a simple rather than a cascode, current source for the current legs, reducing the amount of headroom lost and allowing the use of low voltage transistors in the current legs.

Typically, the bandgap reference circuit 12 operates when line 20 provides a voltage of at least 2 volts. When the start up signal is provided on line 22, transistor 60 is turned on to allow current flow through transistors 70 and 72. The mirrored current also flows through transistors 64, 74 and 76. Once this current is initiated, and $V_{DD}$ (line 20) reaches at least two volts, the reference is self-sustaining. When $V_{DD}$ reaches 2.5 volts, the start up circuit removes all gate drive to transistor 60, shutting off transistor 60 and preventing transistor 60 from causing current imbalance in the legs of the bandgap reference circuit.

The 5 volt regulator circuit 14 amplifies the reference signal generated by the bandgap reference circuit and provided on line 18. In general, 5 volt regulator circuit 14 comprises a series regulator coupled between voltage supply line 16 and the regulated voltage output $V_{DD}$ on line 20. Transistor 110 is a high voltage p channel MOS device used as the series pass transistor controlling the voltage level on line 20. The drive voltage for the gate of transistor 110 is the amplified error between the reference voltage output on line 18 and the feedback from the output voltage on line 20. Feedback from line 20 is tapped off of the resistor divider comprising of resistors 118 and 120. The tapped position sets the voltage output at line 20.

The error between the feedback signal on line 119 and the voltage reference on line 18 is amplified by a differential amplifier comprising transistors 68, 88, 90, 92 and 94 providing the amplified output on line 95. The signal on line 95 is further amplified by the gain stage comprising transistor 96 and resistor 100. The output on line 101 is the drive voltage for series pass transistor 110. Resistor 100 allows line 101 to pull the gate of transistor 110 to battery voltage to reduce battery current drain when transistor 110 is off or when an active load is being driven. During start up, the start up signal on line 22 activates transistor 102, which gates transistor 110 fully active, causing an initial charging of the signal $V_{DD}$ on line 20. Capacitor 104 and resistor 106 provide stability for the amplifier loop of the circuit.

In the event that a voltage drop of the supply voltage or a reverse battery voltage is applied to the regulator circuit, the apparatus according to this invention includes means for preventing diffused junctions in the integrated circuit from forward biasing, which could cause chip destruction due to unlimited current flow and the generation of heat.

Transistor 110 is a p channel MOS device in a diffused n well, which is fabricated in a p substrate. Typically, the n well is tied hard to the most positive supply, which here is the battery supply line 16. This prevents the p drain and the source diffusions of the transistor from forward biasing with the n well. If the tying of the n well to the battery supply is maintained during reverse voltage condition across transistor 110, the n well forward biases with the drain of transistor 110 and, in negative battery conditions, with the grounded p substrate, potentially causing damage to the integrated circuit. To prevent this, the apparatus of this invention actively couples and decouples the n well to and from the battery supply line 16 through transistor 112.

The n well of transistor 110, along with the n wells of any other diffused transistors and/or resistors that are connected to the supply line 16, are connected to line 113, the n well control line. Active control of line 113, as explained below, provides a suitable n well bias control for all high voltage n well transistors and resistors in the circuit that are connected to the supply line 16.

In normal operation, transistor 116 is shut off since its gate is more positive than its source. In this condition, the gate of transistor 112 is held to ground through resistor 114. As the battery voltage rises during normal start up and reaches a p channel threshold voltage, transistor 112 is turned on pulling n well control line 113 to battery. If the battery level on line 16 goes below the level on line 20 (including going negative), transistor 116 turns on, pulling line 115 to the output voltage $V_{DD}$ on line 20, holding off transistor 112, thereby decoupling the n well control line 113 from the battery supply line 16. With transistor 112 off and the n well control line 113 decoupled from battery supply line 16, the p diffusions in the integrated circuit that are tied to battery, such as the source of transistor 110 and such as resistor 100, can be pulled negative with no detrimental effect and no forward biasing of the diffused junction.

Transistors 98 and 108 are active to prevent current flow from line 20 back to the battery supply line 16 when the battery voltage on line 16 drops to ground or goes negative. This allows a much longer decay time on line 20 during a temporary or permanent power fault.

The longer decay time on line 20 provides an advantage that is useful in implementations in which it is desirable to update non-volatile memory during power disconnect fault conditions. The drop in the supply voltage on line 16 can be easily sensed and used to trigger a memory update command, using the power still provided on line 20 to update the memory before line 20 decays. This advantageous implementation can be easily implemented by one skilled in the art using the information provided herein.

During normal operation, n channel transistor 98 is turned on hard from positive voltage supply to line 16. In this state, transistor 98 holds line 97 to ground. Also, p channel transistor 108 is held off due to the positive voltage generated by the difference between the supply voltage on line 16 and the regulated voltage supply $V_{DD}$ on line 20. When the supply voltage on line 16 falls below the level on line 20 by a threshold voltage, transistor 108 starts to short the gate to source circuit of transistor 110, causing transistor 110 to turn off. Transistor 98 turns off when the supply voltage on line 16 is sufficiently low, allowing transistor 108 to completely pull node 101 to the voltage level at line 20, maintaining transistor 110 off, in which state the source to drain circuit of transistor 110 no longer couples line 20 to supply line 16. In this state, the reverse current between line 20 and line 16 is limited to the current allowed to flow through resistor 100.

The above-described implementations of this invention provide start up for a bandgap reference voltage supply and provides voltage drop and reverse current protection to a circuit without the necessary addition of an external or internal series diode. In addition, reverse current draw from the output reference voltage is limited, allowing a gradual decay of the output voltage.

The protection provided by this invention against reverse biasing of diffused junctions in the substrate can be generically applied to integrated apparatus that include diffused junctions in devices that are tied to one of the voltage supply terminals.

Figure 4:
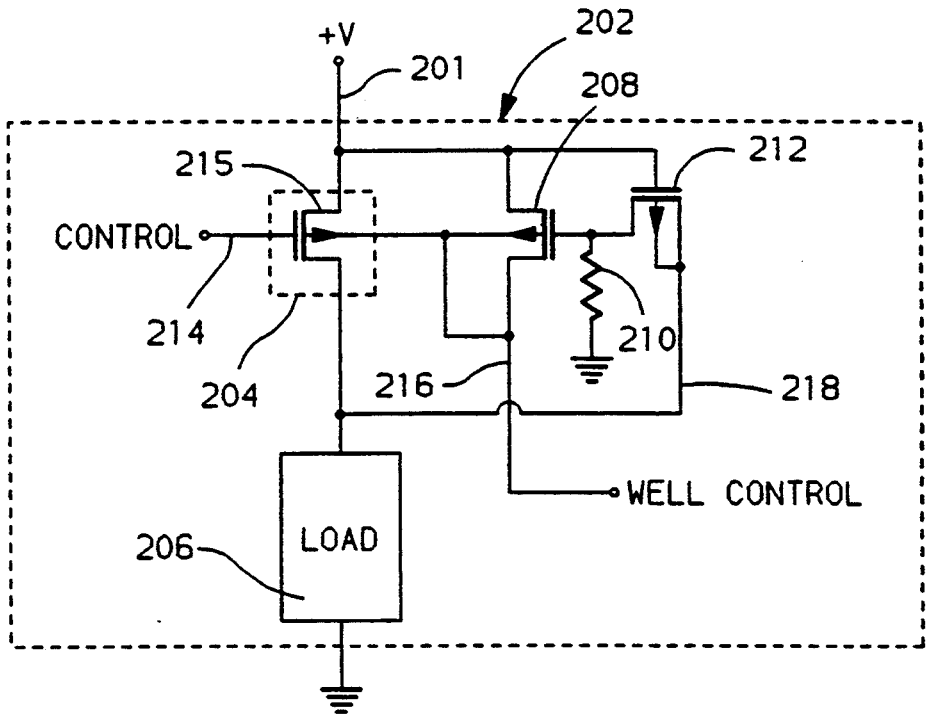
FIG. 4 illustrates an apparatus according to this invention employing the method of this invention.

Referring to FIG. 4, the circuit 202 shown is integrated onto a p-type substrate and includes at least one n well device 204 that is tied to the supply voltage line 201. The n well device 204 is a p channel MOS device with an n well diffused into the p-type substrate. Typically, the n well 215 of n well device 204 would be tied directly to the voltage supply line 201 to prevent forward biasing of drain and source diffusions. However, according to this invention, the n well 215 is tied to an n well control line 216 having voltage levels controlled by switching device 208. Switching device 208, during normal operating conditions, has a gate that is grounded via resistor 210. In this state, switching device 208 couples well control line 216 to the voltage supply line 201, tying n well 215 to the voltage supply line. In a reverse voltage condition, a reverse voltage across the n well device 204 is sensed by a means (transistor 212) for sensing a reverse voltage condition across the n well device. When line 201 falls below line 218, transistor 212 switches active pulling the gate of switching device 208 above ground, turning off switching device 208. When device 208 is switched off, well control line 216 is no longer coupled to the supply voltage line 201 and, correspondingly, n well 215 is no longer coupled to supply voltage line 201.

Decoupling n well 215 from supply voltage line 201 during reverse voltage conditions prevents the diffused n well junction of device 204 from forward biasing due to the reverse voltage across the device 204. As a result, no reverse bias current is allowed to flow through device 204, preventing chip destruction due to out of control current flow and heat generation.

In the apparatus shown in FIG. 4, the n well device 204 is a transistor controlled by a signal on line 214 and coupled to a load 206, which may be an on-chip load, off-chip load, or a combination of both. Transistor 204 corresponds to transistor 110 in FIG. 3. Transistors 208 and 212 correspond to transistors 112 and 116. Resistor 210 corresponds to resistor 114 and load 206 corresponds to resistors 118 and 120 and the load on line 20 in FIG. 3. The n well device 204 need not be a transistor as it can be any n well device including a resistor. In addition many n well devices, both transistors and resistors, may be coupled to n well control line 216 for reverse voltage protection, using the voltage across one representative device, such as device 204, for the sensing of a reverse voltage condition.

The example shown in FIG. 4 is for n well devices in the p-type substrate. This invention can also be used to protect p-well devices in n type substrates by using appropriate p well devices in place of the n well devices and by reversing the polarity of the device.

The method of this invention exemplified by the operation of the circuit apparatus shown in FIG. 4 is a method of operating an integrated circuit integrated on a substrate of a first type (i.e., p-type or n-type), comprising devices that include diffused junctions of a second type. For example if the substrate is p-type, the diffused junctions of the second type are n-type. Conversely, if the substrate is n-type, the diffused junctions of the second type are p-type. The diffused junctions are characterized by wells of the second type. The method of operating the integrated circuit according to this invention comprises the steps of selectively coupling the wells of the diffused junctions to an extreme voltage terminal. The extreme voltage terminal is the most positive or most negative terminal, depending upon the implementation. For n-type diffused junctions in p-type substrates, the extreme voltage terminal is the most positive terminal in typical operation, i.e., line 201 in FIG. 4, line 16 in FIGS. 1–3. For p-type diffused junctions in n-type substrates, the extreme voltage terminal is the most negative terminal in typical operation, i.e., ground. The method according to this invention includes the step of monitoring a voltage across at least one of the devices with a diffused junction to detect a reverse voltage condition across the one device, i.e., the function performed by transistor 212 in FIG. 4. Responsive to a detected reverse voltage condition, the wells of the diffused junctions are selectively decoupled from the extreme voltage terminal, i.e., through control of transistor 208 in FIG. 4.

The above-described implementations of this invention are example implementations. The apparatus and method of this invention are ideal for implementation into a motor vehicle, in which case the power supply line 16 is coupled to the vehicle's power supply. However, the apparatus and method of this invention are not limited to use with motor vehicles and may be used with any external source of electrical power.

Moreover, various improvements and modifications to this invention may occur to those skilled in the art and such improvements and modifications will fall within the scope of this invention as set forth below.

The embodiments of the invention in which an exclusive property or privilege is claimed are defined as follows:

1. An apparatus comprising:

a bandgap reference voltage circuit means for generating a bandgap reference voltage based upon an input of regulated voltage, wherein the bandgap reference voltage circuit requires an input of startup current when the regulated voltage is below a predetermined startup level to insure stable operation;

a voltage regulator circuit means for generating the regulated voltage on a regulator output line based upon the bandgap reference voltage and a supply voltage on a power supply line, wherein the regulated voltage increases to a desired regulated voltage level during a startup period when the supply voltage is initially applied to the supply line;

a startup circuit means coupled to the supply line and the voltage regulator circuit means for sensing the regulated voltage and for generating a startup signal from the supply voltage during the startup period when the regulated voltage is below the predetermined startup level; and a current supply means responsive to the startup signal for inputting startup current to the bandgap reference voltage circuit means when the regulated voltage is below the predetermined startup level.

2. The apparatus of claim 1, wherein the startup signal is substantially equal to the supply voltage when the regulated voltage is below the predetermined startup level and is essentially grounded when the regulated voltage is above the predetermined startup level.

3. The apparatus of claim 1, wherein the startup circuit means includes:

a resistor connected in series with a transistor between the supply line and a circuit ground with the startup signal being generated at a junction between the series connected resistor and transistor; and startup control means for maintaining the transistor in a substantially open circuit off state during the startup period when the regulated voltage is below the predetermined startup level and for switching the transistor to a substantially closed circuit on state when the regulated voltage is above the predetermined startup level.

4. An apparatus comprising:

a bandgap reference voltage circuit means for generating a bandgap reference voltage based upon an input of regulated voltage, wherein the bandgap reference voltage circuit means requires an input of startup current when the regulated voltage is below a predetermined startup level to insure stable operation;

a voltage regulator circuit means for generating the regulated voltage on a regulator output line based upon the bandgap reference voltage and a supply voltage on a power supply line, wherein the regulated voltage increases to a desired regulated voltage level during a startup period when the supply voltage is initially applied to the supply line;

a startup circuit means coupled to the supply line and the voltage regulator circuit means for sensing the regulated voltage and for generating a startup signal from the supply voltage during the startup period when the regulated voltage is below the predetermined startup level;

a current supply means responsive to the startup signal for inputting startup current to the bandgap reference voltage circuit means when the regulated voltage is below the predetermined startup level; and wherein, the voltage regulator circuit means further includes a regulator control means responsive to the startup signal for generating the regulated voltage directly from the supply voltage by switchably connecting the supply line to the regulator output line during the startup period while the regulated voltage increases to the predetermined startup level.

* * * * *